United States Patent [19]

Wagner

[11] 4,135,585

[45] Jan. 23, 1979

[54] DRILL RIG-CASING DRIVER ASSEMBLY

[76] Inventor: Gary L. Wagner, P.O. Box 902, Burlington, Iowa 52601

[21] Appl. No.: 832,102

[22] Filed: Sep. 9, 1977

[51] Int. Cl.[2] ..... E02D 7/18

[52] U.S. Cl. ..... 173/49; 173/124; 173/123

[58] Field of Search ..... 173/49, 50, 122, 123, 173/124, 81, 84, 88, 89; 175/171

[56] References Cited

U.S. PATENT DOCUMENTS

| | | | |
|---|---|---|---|
| 2,776,539 | 1/1957 | Pearson | 173/123 |
| 3,216,511 | 11/1965 | Ladd et al. | 173/89 |
| 3,448,817 | 6/1969 | Morishita et al. | 173/123 |
| 3,743,030 | 7/1973 | Gifford | 173/124 |
| 3,785,444 | 1/1974 | Gray | 173/124 |
| 3,841,418 | 10/1974 | Biersack | 173/124 |
| 3,937,286 | 2/1976 | Wagner | 173/124 |

*Primary Examiner*—Robert A. Hafer

*Attorney, Agent, or Firm*—Mason, Fenwick & Lawrence

[57] ABSTRACT

An improved drill rig having an auger and casing driver assembly, in combination, wherein a weight assembly is provided in combination with the drill rig assembly to be sequentially impacted upon a casing to be driven simultaneously with operation of the auger which is defining the well hole so that a casing is inserted into the well hole at the same time the well hole is being defined.

7 Claims, 6 Drawing Figures

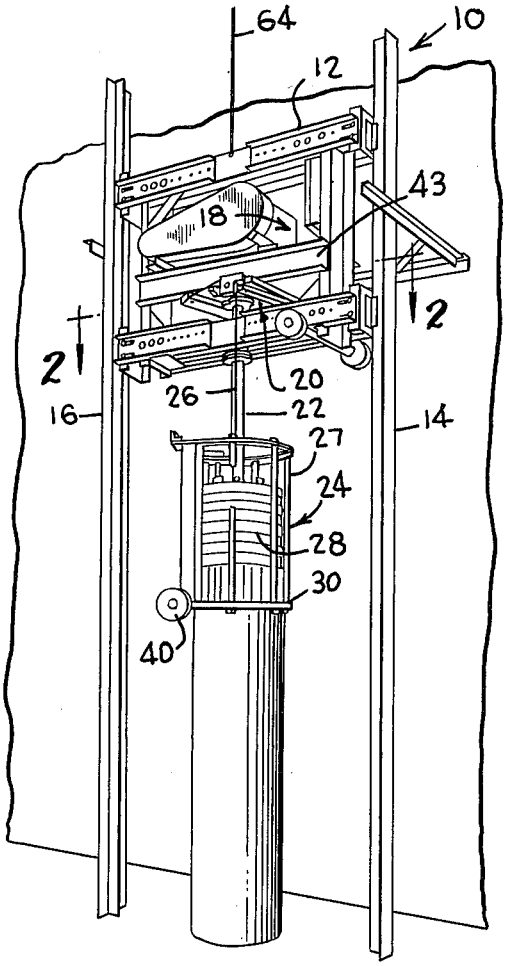
Fig. 1
Fig. 3
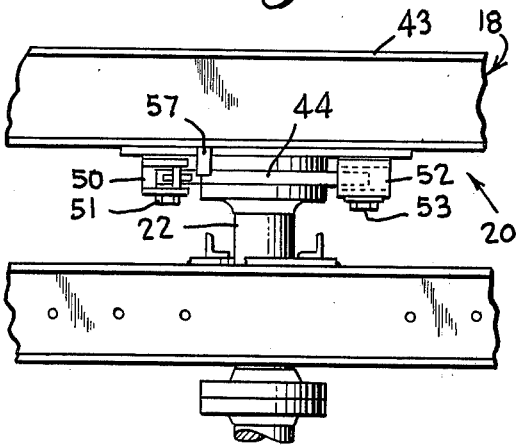
Fig. 2
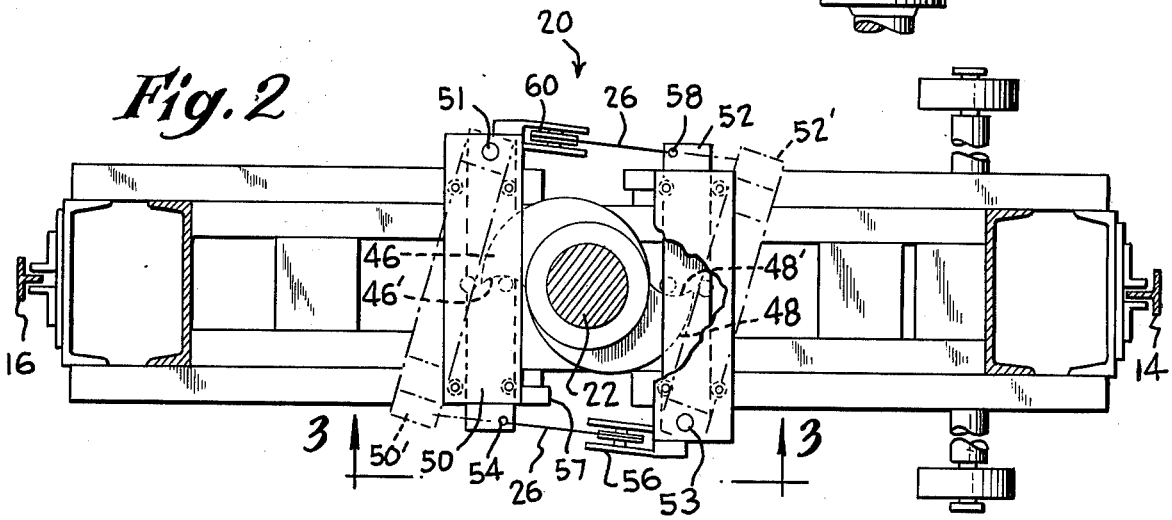

DRILL RIG-CASING DRIVER ASSEMBLY

The present invention is related to an improved drill rig and casing driver assembly. More specifically, the invention is directed to the provision of a casing driver assembly in combination with a drill rig wherein the casing is inserted into the well hole defined by the drill rig at the same time that the auger is boring into the earth from a single direct drive power source so that the well hole is protected during the drilling action.

Many different devices have been provided in the art for drilling openings in the earth and for impacting casing within a well hole after the well hole has been defined. The present invention, however, is directed to the provision of a combined drilling and casing driving assembly from a single direct drive power source which will provide means for protection of the well hole as soon as the well hole is defined by the auger boring into the earth.

It is a primary object of the present invention to provide a new and improved drill rig and casing drive assembly.

Another object of the present invention is to provide means for protection of a well hole by insertion of a casing simultaneously with definition of the well hole by the auger.

An additional object of the present invention is to provide means for defining the well hole prior to removal of material by the auger.

Other objects and advantages of the present invention is the provision of an improved drill rig assembly which is economical to manufacture, easy to use, durable in use, and which is relatively readily maintained in use.

A further object of the present invention is to provide an improved drill rig and casing driver assembly which is portable, non-truck mounted, and easily installed for use in constructing hydraulic elevators in existing buildings.

Other objects and advantages of the invention will become more apparent to those persons having ordinary skill in the art to which the present invention pertains from the following description taken in conjunction with the accompanying drawings wherein:

FIG. 1 is a fragmentary elevation showing a preferred embodiment of the present invention including power head, drill rig, and casing driver;

FIG. 2 is a fragmentary top plan view, illustrating the cam and traverse arms associated with the device taken along line 2—2 in FIG. 1;

FIG. 3 is a fragmentary view in elevation showing cam assembly and mounting assembly taken along line 3—3 in FIG. 2;

Figure 4:
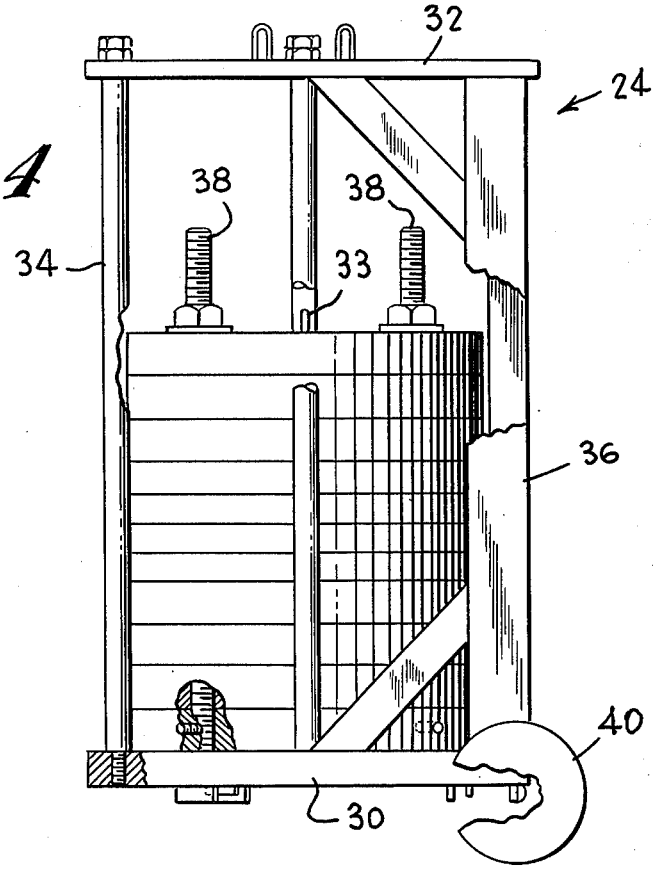
FIG. 4 is a fragmentary side elevation showing the casing driver assembly and cage associated with the weight assembly.

Referring more specifically now to the drawings, the drill rig and casing driver assembly is indicated in FIG. 1 by reference numeral 10. The drill rig and casing driver assembly includes an assembly carriage 12 which is guidingly received along the upstanding guide rails 14 in a typical elevator installation.

The carriage 12 is adapted to operatively support a motor assembly 18 and a cam assembly 20 as illustrated in FIG. 1 of the drawings. The motor assembly 18 is adapted to be powered by any suitable power source such as electrical, hydraulic, pneumatic or the like for rotating an output shaft 22 to drive the auger or drill bit and the casing driver assembly. In the specific embodiment set forth herein, an electrical motor is employed.

As illustrated in FIG. 1 of the drawings, a casing driver assembly 24 is resting on a casing 29 which is being inserted in the well hole. An actuation cable 26 operatively connects the impact weights 28 to the cam assembly 20. The casing driver assembly 24 includes a frame assembly 27 and a plurality of impact weights 28 in assembled relation within the frame assembly 27. The impact weights are disc-shaped with an opening into the center thereof to permit positioning in a lateral direction of the weights around the drive shaft. The frame assembly 27 defines a central opening through which the output shaft 22 of the motor assembly 18 extends. The casing driver assembly 24 extends about the output shaft 22 in a manner which avoids any contact between the casing driver assembly and the output shaft to permit free movement of the shaft and the assembly with respect to each other.

The output shaft 22 is operatively connected to a drill bit or auger of conventional construction which rotates to cause the earth to be loosened for removal from the well hole. This drilling or augering defines the well hole although in some soils the casing may be driven ahead of the drill or auger.

It should be noted that when the drill rig is used to define a well hole in soft sand or other unstable earth conditions, the earth defining the wall of the well hole being drilled by the rig assembly 10 will tend to collapse or flow into the well hole thereby inhibiting the definition of a suitable well hole. Furthermore, should soil conditions such as sand or quicksand exist, the present invention permits the driving of the casing, one to two feet or more ahead of the auger. This not only prevents loss of definition of the well hole, but restricts quicksand or sand flow upward into the well hole to minimize an amount of sand or quicksand being removed from the well hole. A conventional practice has been to define a well hole and then promptly drive a casing into the well hole defined by use of the casing to provide a stable wall for the well hole. With this practice, the auger or drill bit must first be removed before the casing can be driven into the well hole.

Figure 5:
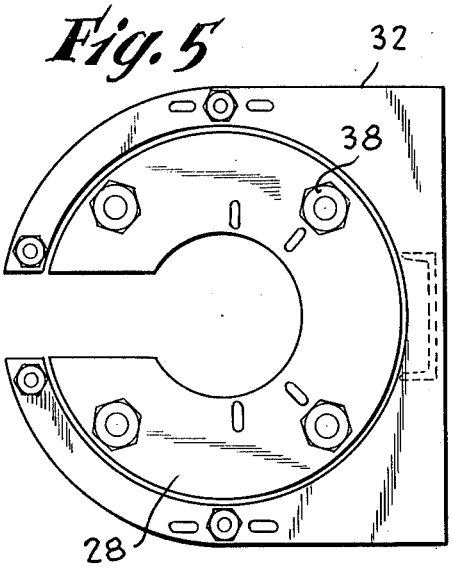
FIG. 5 is a top plan view of the head of the casing drive frame.
Figure 6:
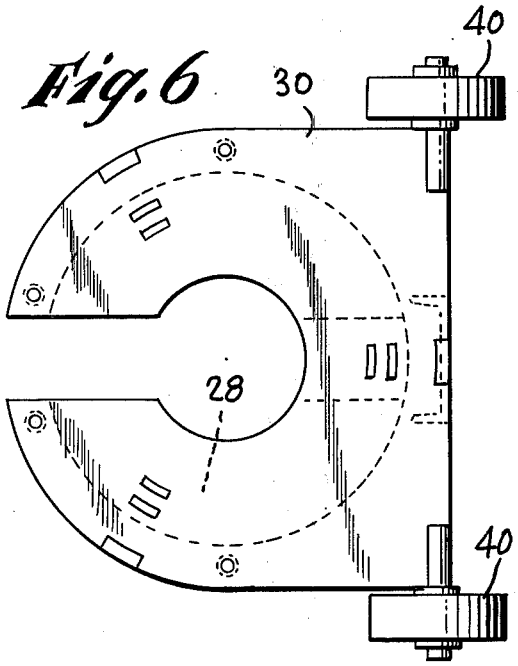
FIG. 6 is a top plan view of the base of the casing driver assembly.

As illustrated in the drawings, the weight assembly 24 of the drill rig 10 includes a base 30 and head 32. The base 30 and head 32 are joined by spacers 34 and angles 36 to define an enclosure for the impact weights 28 supported within the enclosure. The weights 28 are bolted together as indicated in FIG. 5 of the drawings to define a rigid weight assembly for disposition within the enclosure of the assembly 24. Additional weights may be added by placing the disc-shaped weight elements in stacked relation within the assembly 24, as shown in FIG. 4, to provide an appropriate force for driving of the casing 38 into the ground.

The bolts 38 extend fully through the disc-shaped weights to create a rigid weight. A pair of wheels 40 is provided at one end of the base 30 of the assembly 24 to provide for convenient means in handling of the weight assembly when the drill rig 10 is disassembled for movement to another location. A dolly handle may be provided for easy transportation of the weight assembly.

The cam assembly 20 includes a frame 43 and a cam element 44 having opposed, spaced apart extended cam surfaces 46 and 48 with interposed recessed cam surfaces 46′ and 48′ as illustrated in FIG. 2 of the drawings. Traverse arms 50 and 52 are pivotally mounted on bolts 51 and 53 threadingly engaged in frame 43, as illustrated in FIGS. 1 and 2 of the drawings, and follow the cam surfaces 46 and 48 and the recessed interposed cam surfaces 46′ and 48′ as the cam element 44 rotates.

The traverse arm 50 is adapted to move in response to urging from the cam surface 46 to the position shown at 50′ in the dashed lines of FIG. 2 and to move inwardly to the position adjacent a traverse arm stop 57 as shown by the solid lines in FIG. 2 in response to the position of the recessed surface 46′ on the cam element 44.

As shown in FIG. 2, one end of the cable 26 is attached to a pin 54 of the traverse arm 50, the pin 54 being on the end opposite from the pivot bolt 51 of the traverse arm 50. The cable 26 extends over a pulley 56 and downwardly, as shown in FIG. 1, wherein the opposite end of the cable 26 is attached to a lifting eye 33 of the impact weights 28 as shown in FIGS. 1 and 4.

One end of the cable 26 is attached to a pin 58 of the traverse arm 52 and extends over a pulley 60 with the other end of said cable 26 being attached to a lifting eye 33 of the impact weights 28.

The cam element 44 is fixed to the shaft 22 of the motor assembly 18 thereby causing the cam element 44 to rotate with rotation of the shaft 22. It can readily be seen that as the shaft 22 and cam 44 rotate, the traverse arms 50 and 52 will rotate about bolts 51 and 53, respectively, to pull the cables 26 over the pulley 56 and 60 to lift the impact weights. This movement of the cables 26 will lift the weights 28 above the base 30 within the assembly 24. Since the base 30 of frame assembly 24 rests atop the casing to be driven, rotation of the cam element 44 will cause the weights 28 to repeatedly impact upon base 30. This impact will be directly transmitted to casing 29, as suggested in FIG. 1 of the drawings.

In operation, the drill rig 10 is lowered by a hoist cable 64 which is controlled by the person operating the drill rig. The casing 29 receives the auger and the base plate 30 of the frame assembly 27 is brought into contact with the top of the casing as shown in FIG. 1. The motor of the motor assembly 18 is energized which causes the drill or auger to rotate. The drill rig is lowered until the weights 28 contact the base 30 within the travel of cables 26. The operator lowers the drill rig at a rate sufficient to permit the weights to impact the base. If he does not lower them fast enough, the base 30 will move below the lowest point of travel of the weights and no impacts will occur. If the operator lowers the drill rig too rapidly, the weights will not be lifted away from the base 30 and again no impacts will occur.

From the foregoing detailed description it will be evident that there are a number of changes, adaptations and modifications of the present invention which come within the province of those skilled in the art. However, it is intended that all such variations, not departing from the spirit of the invention, be considered as within the scope thereof as limited solely by the appended claims.

I claim:

1. An improved drill and casing driver assembly which is portable, non-truck mounted, and easily installed for use in constructing hydraulic elevators in existing buildings, to forcibly insert casing into a well hole as the well hole is being drilled, said assembly comprising: a frame, a drilling device rotatably mounted on said frame for drilling a well hole, power means mounted on said frame and having a rotatable output shaft adapted for rotatably driving said drilling device, and a casing driver assembly having a cam means fixed to the output shaft, a cam follower mounted on said frame and engageable with said cam means to cause the cam follower to move as the output shaft rotates, and an impact weight operatively connected to said cam follower and adapted to be repeatedly dropped against the casing to drive the casing into the well hole as the well hole is being drilled by the drilling device to permit simultaneous insertion of the casing into the well hole as the well hole is being drilled.

2. The drill and casing driver assembly of claim 1 additionally including a flexible cable operatively connecting said cam follower with said impact weight to raise and lower said impact weight as said cam follower moves.

3. The drill and casing driver assembly of claim 1 additionally including a weight assembly frame having a base seatable against an upper end of said casing, said impact weight slidable within said weight assembly and operatively connected to said cam follower to permit raising and lowering of said impact weight for repeatedly contacting said base thereby impacting the casing to force the casing into said well hole.

4. The drill and casing driver assembly of claim 2 additionally including a weight assembly frame having a base seatable against an upper end of said casing, said impact weight slidable within said weight assembly and operatively connected to said cable to permit raising and lowering of said impact weight for repeatedly contacting said base thereby impacting the casing to force the casing into said well hole.

5. The drill and casing driver assembly of claim 1 wherein said cam means includes diametrically opposed lobes and wherein said cam follower is pivotally mounted on said frame thereby causing said cam follower to oscillate twice for each rotation of said output shaft.

6. The drill casing driver assembly of claim 1 additionally including guideways mounted on said frame for slidable movement on upstanding guide rails thereby permitting use of said assembly on the guide rails of conventional elevator shafts.

7. The drill and casing driver assembly of claim 4 additionally including guideways mounted on said frame for slidable movement on upstanding guide rails thereby permitting use of said assembly on the guide rails of conventional elevator shafts.

* * * * *